US011084990B2

(12) United States Patent
Morrill et al.

(10) Patent No.: US 11,084,990 B2
(45) Date of Patent: Aug. 10, 2021

(54) MAXIMIZING OCTANE SAVINGS IN A CATALYTIC DISTILLATION UNIT VIA A DUAL REACTOR POLISHING SYSTEM

(71) Applicant: PHILLIPS 66 COMPANY, Houston, TX (US)

(72) Inventors: Michael R. Morrill, Bartlesville, OK (US); Dennis A. Vauk, Houston, TX (US); Daniel Todd Seach, New Orleans, LA (US); Rory James Falgout, Harvey, LA (US); Timothy A. Dixon, Belle Chasse, LA (US)

(73) Assignee: Phillips 66 Company, Houston, TX (US)

( * ) Notice: Subject to any disclaimer, the term of this patent is extended or adjusted under 35 U.S.C. 154(b) by 0 days.

(21) Appl. No.: 16/715,319

(22) Filed: Dec. 16, 2019

(65) Prior Publication Data

US 2020/0190411 A1 Jun. 18, 2020

Related U.S. Application Data

(60) Provisional application No. 62/780,600, filed on Dec. 17, 2018, provisional application No. 62/780,638, filed on Dec. 17, 2018.

(51) Int. Cl.
*C10G 65/04* (2006.01)
*C10G 45/04* (2006.01)

(52) U.S. Cl.
CPC ..... *C10G 65/04* (2013.01); *C10G 45/04* (2013.01); *C10G 2300/202* (2013.01); *C10G 2400/02* (2013.01)

(58) Field of Classification Search
CPC .. C10G 65/00; C10G 65/02; C10G 2300/104; C10G 2300/1044; C10G 2300/202; C10G 2300/4087; C10G 2400/02; C10G 67/14; C10G 2300/305; C10G 65/04; C10L 1/06; C10L 2200/0423; C10L 2270/023; C10L 2200/0263
See application file for complete search history.

(56) References Cited

U.S. PATENT DOCUMENTS

2012/0048778 A1* 3/2012 Podrebarac ..... C10G 35/06 208/210
2018/0155640 A1* 6/2018 Dalal ..... C10G 67/06

* cited by examiner

*Primary Examiner* — Randy Boyer
*Assistant Examiner* — Juan C Valencia
(74) *Attorney, Agent, or Firm* — Phillips 66 Company

(57) ABSTRACT

Low sulfur gasoline blend stock is produced by a hydrodesulfurization process including at least two hydrodesulfurization reactors with hydrogen feeds and two finishing reactors arranged where the first polishing reactor converts both thiophenic compounds and mercaptans to hydrogen sulfide and hydrocarbons and the second polishing reactor uses a catalyst that has much less thiophenic conversion activity but is operated at a higher temperature to more substantially reduce the sulfur content of the gasoline present in the form of mercaptans. As the conversion of thiophenes to hydrogen sulfide is correlated to reducing octane number, using a second polishing reactor that has little activity for thiophene conversion also protects the high-octane species in the gasoline thereby minimizing octane loss while reducing total sulfur content to acceptable levels. The sulfur left in the gasoline is biased toward higher thiophene content and away from mercaptan content.

7 Claims, 2 Drawing Sheets

MAXIMIZING OCTANE SAVINGS IN A CATALYTIC DISTILLATION UNIT VIA A DUAL REACTOR POLISHING SYSTEM

CROSS-REFERENCE TO RELATED APPLICATIONS

This application is a non-provisional application which claims benefit under 35 USC § 119(e) to U.S. Provisional Application Ser. No. 62/780,600 filed Dec. 17, 2018, entitled "Maximizing Octane Savings in a Catalytic Distillation Unit via a Dual Reactor Polishing System", and to U.S. Provisional Application Ser. No. 62/780,638 filed Dec. 17, 2018, entitled "Maximizing Octane Savings in a Catalytic Distillation Unit via a Dual Reactor Polishing System", both of which are incorporated herein in their entirety.

STATEMENT REGARDING FEDERALLY SPONSORED RESEARCH OR DEVELOPMENT

None.

FIELD OF THE INVENTION

This invention relates to refining hydrocarbons and particularly to operating catalytic hydrotreating units to reduce sulfur in fuel products and most particularly to removing sulfur in gasoline.

BACKGROUND OF THE INVENTION

Sulfur in motor fuel causes tailpipe pollution and is therefore significantly limited by regulatory authorities. Since it is naturally occurring in crude oil, oil refineries must include process systems to remove sulfur from the fuel products before they are brought to market. Sulfur is typically bound up in liquid fuels in a variety of molecules primarily including mercaptans and thiophenes. Typical processes to remove sulfur focus on converting the sulfur containing compounds to hydrogen sulfide that is more easily separable from gasoline. Unfortunately, processes that convert the sulfur compounds to hydrogen sulfide also convert other highly valued components of motor fuels to much less desirable constituents. For gasoline, preserving high octane species is quite interesting to refinery operators as higher-octane gasoline blend stock is quite valuable owing to its capacity to be blended with very low-cost sub-spec liquids and yield a combined volume of product to sell at gasoline prices. Losing octane to reduce sulfur content may be necessary but represents a lost profit opportunity. In other words, octane loss has substantial economic impact and, therefore, the goal for any sulfur management process focuses on the necessary job of converting the sulfur while trying to preserve as much of the desirable components as possible.

The problem is exacerbated by tightening sulfur specs as the process efforts to remove the last bits of sulfur have to be pretty aggressive and those aggressive process conditions really take their toll on the most valued components. In addition, more and more crude oil production is coming from higher sulfur formations. Low sulfur content crude oil is called "sweet crude" and high sulfur crude is called "sour crude" and it turns out that the world seems to have way more sour crude than sweet crude. So, as crude oils are produced with higher and higher sulfur contents and regulatory authorities are imposing ever more restrictive environmental regulations limiting sulfur content to a very low ppm range, crude oil refiners must undertake greater and more aggressive efforts to remove sulfur from fuel products.

For gasoline, a significant portion of the sulfur content comes from catalytic cracking of the heavier crude oil components where sulfur tends to concentrate itself in the heavier fractions from the initial distillation processes of the crude. As the heavier components of the crude are subjected to cracking to convert the heavier molecular weight species into gasoline range species, the sulfur compounds end up in gasoline streams. Before this cracked gasoline is blended with other gasoline, it is typically subjected to its own hydrodesulfurization treatment process to convert the heavier sulfur containing compounds into more easily separated lighter sulfur compounds such as hydrogen sulfide.

Current hydrodesulfurization treatment processes are capable of reducing the sulfur content sufficient to meet the newest specifications, but at considerable octane loss. At previous specifications that allowed more sulfur, the octane loss was seen, but was not severe. As noted above, it appears that the most significant octane loss is sustained at the most aggressive conversion conditions for converting mercaptans and thiophenic compounds to hydrogen sulfide.

Improved sulfur removing technology is needed and desired for meeting gasoline demand for very low sulfur content specifications.

BRIEF SUMMARY OF THE DISCLOSURE

The invention more particularly relates to a system for desulfurizing a gasoline stream to or below a target sulfur content specification for finished gasoline that also minimizes concurrent octane loss. The system includes a first hydrodesulfurizing reactor with a hydrogen feed and hydrodesulfurizing catalyst at catalytic conditions to convert hydrogen and sulfur compounds to hydrocarbons and hydrogen sulfide to create a first pass sulfur converted gasoline stream and a separator for separating hydrogen sulfide from the first pass sulfur converted gasoline stream to create a first pass desulfurized gasoline stream. One or more additional hydrodesulfurizing reactors are provided where each has a hydrogen feed and hydrodesulfurizing catalyst at catalytic conditions to convert hydrogen and sulfur compounds to hydrocarbons and hydrogen sulfide to create a follow up pass sulfur converted gasoline stream along with a separator for separating hydrogen sulfide from the follow up pass sulfur converted gasoline stream to create a follow up pass desulfurized gasoline stream. The invention further includes a thiophenic polishing reactor with a hydrodesulfurizing catalyst where the catalyst is selected to have a first polishing catalytic activity to convert thiophenes and mercaptans to hydrogen sulfide and hydrocarbons and where the sulfur content in the thiophenes is thereby reduced to a level below the target specification for finished gasoline, but where the total sulfur content is still above the target specification for finished gasoline creating a sulfur converted semi polished gasoline stream along with a separator for separating hydrogen sulfide from the sulfur converted semi polished gasoline stream to create a degassed semi polished gasoline stream. A heater is arranged for heating the degassed semi polished gasoline stream to a higher temperature which is fed to a mercaptan polishing reactor having a hydrodesulfurizing catalyst where the catalyst is selected to have a second polishing catalytic activity but where the second polishing catalytic activity is selected to be less active for thiophene conversion such that within the mercaptan polishing reactor the mercaptans are converted to hydrogen sulfide and hydrocarbons where the sulfur content in the mercaptans becomes less than the sulfur content in the thiophenes and wherein the total sulfur content of the gasoline is reduced to a level equal to or below the target specification for finished gasoline to create a sulfur converted fully polished gasoline stream. A separator is arranged for separating hydrogen sulfide from the sulfur converted fully polished gasoline stream to create a degassed fully polished gasoline stream.

BRIEF DESCRIPTION OF THE DRAWINGS

A more complete understanding of the present invention and benefits thereof may be acquired by referring to the following description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
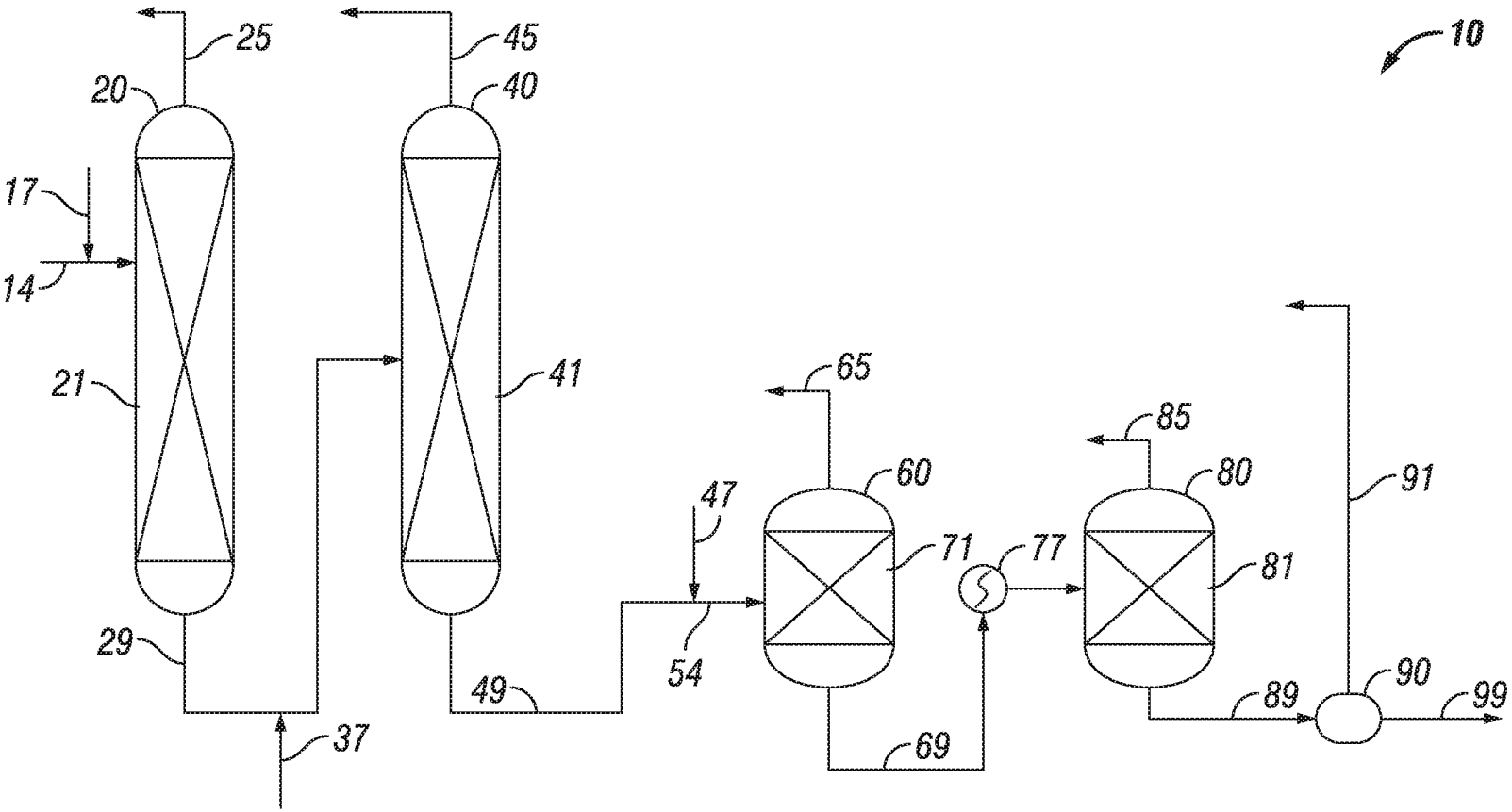
FIG. 1 is simplified flow process diagram of the invention showing two hydrodesulfurization reactors and a set of paired polishing reactors that work together to maintain as much octane rating for the gasoline components while driving the sulfur content to very low levels.

Turning to FIG. 1, removing sulfur from gasoline is generally necessary to meet fuel specification regulations as sulfur is naturally occurring in most crude oils and does not easily separate from the hydrocarbon fuels produced in hydrocarbon refineries. A simplified gasoline desulfurization system 10 is shown in FIG. 1 for reducing sulfur content from a gasoline range molecular-weight hydrocarbons cut supplied by an inlet conduit 14. Hydrogen is supplied via hydrogen supply line 17. The sulfur content of this gasoline cut feed is expected in the range of between about 0.05% and up to about 2.5% on a weight basis. The gasoline cut may come straight from a crude oil fractionation tower or may have been the product of another refinery operation such as a cracking process or other gasoline range production system prior to hydrodesulfurization or be a blended product from multiple sources. In the preferred arrangement, the raw gasoline stream is a product from a fluidized catalytic cracker or FCC (not shown) that has been supplied with a heavy fraction from a crude unit (not shown) which fractionates the crude oil into various boiling point fractions. Heavy fractions created from sour crudes typically have liquid sulfur compounds in the forms of mercaptans and thiophenic compounds which are supplied to the FCC. The gasoline product from the FCC includes these sulfur compounds.

In the system 10, a first hydrodesulfurization reactor 20 uses a hydrodesulfurization catalyst in a fixed bed 21 at catalytic conditions (about 100 to 200° C. and 1 to 4 atmospheres pressure) to use hydrogen to convert sulfur compounds to form hydrocarbons and hydrogen sulfide, the second of which is more easily separated from liquid fuel. The hydrogen sulfide produced in reactor 20 is separated from the liquid gasoline cut either in the reactor itself or in a separator downstream of the reactor. In FIG. 1, the reactor 20 is shown as a catalytic fractionation reactor which has a top outlet 25 for the light products including the hydrogen sulfide and bottom outlet 29 for the heavier fraction. The light ends are directed for further treatment the sulfur is eventually removed by amine gas treating (not shown) as is known in the art. The heavier materials with now reduced sulfur content gasoline material is delivered to a second reactor 40. With the hydrogen sulfide removed, more aggressive treatment is practical as residual hydrogen sulfide tends to recombine with olefins to re-create sulfur containing mercaptans which the gasoline desulfurization system 10 is supposed to be removing from the gasoline.

The sulfur remaining in the gasoline stream is typically in forms that are less reactive at the conditions in the first hydrodesulfurization reactor 20 and, those sulfur bearing compounds may be subjected to more aggressive hydrotreating conditions in a second hydrodesulfurization reactor 40 with less concern about recombination reactions occurring because of the diminished hydrogen sulfide content. The conditions will still not be so aggressive to cause many of the olefins to become saturated. As olefins may comprise a significant portion of the gasoline product (up to about 35%), the conversion of olefins to alkanes would substantially reduce the octane rating and, therefore, would significantly compromise market value of the gasoline product.

Like with reactor 20, hydrogen is fed via line 37 and the hydrodesulfurization catalyst bed 41 in reactor 40 uses the hydrogen to convert more sulfur containing compounds to hydrocarbons and hydrogen sulfide. The conditions in reactor 40 may be similar to the conditions in reactor 20 but are preferably more aggressive to remove the more resistant sulfur compounds from the gasoline stream. Again, reactor 40 is shown as catalytic fractionator with a light end top outlet 45 to direct hydrogen sulfide along with other light ends to amine gas treating or other processing. It is noted that there are many optimizing processes that are known in the art that may be employed for reactors 20 and 40 and that are not shown but may be included with the system of the present invention.

Within reactors 20 and 40 a number of reactions occur concurrently, and some are desirable, and some are not. One of the additional desirable reactions is the conversion of di-olefins to mono-olefins. The sulfur bearing species that are more reactive to the hydrogen and hydrodesulfurization catalysts are most likely converted in one of these two reactors 20 and 40. The undesirable reactions include the saturation of olefins (which reduces octane), the saturation of aromatics (which reduces octane) and any olefin recombination with hydrogen sulfide to recreate a mercaptan.

The gasoline stream at outlet 49 contains about 30-300 ppm sulfur, which is still too high for current specifications. So, focusing now on the more key aspects of the invention, the next two reactors are polishing reactors to clean up the sulfur content of the gasoline stream to a very small constituent amount that is preferably less than or equal to about 10 ppm. To get the sulfur content down to such a low constituent, the inventors have observed that the conversion of mercaptans to hydrogen sulfide strongly correlates to the temperature of the conversion reaction in an equilibrium relationship and can be performed with a less aggressive catalyst formulation that has little activity for hydrogen conversion of thiophenes. Therefore, the strategy for reducing sulfur content can be different for thiophenes than for mercaptans. It is also observed that thiophene conversion is relatively highly correlated to aromatic saturation. With these observations, the inventors have come up with a way to reduce sulfur content down to the ultra-low levels that the fuel sulfur specifications require but preserves a higher-octane number for the fuel or more of the existing high-octane species in the gasoline stream as practical. The process essentially focuses on removing as much sulfur containing mercaptans as possible or practical while removing simply a sufficient amount sulfur containing thiophenes to meet the specification. So, more thiophenes will be present in the final gasoline product than mercaptans and with more thiophenes, higher-octane aromatic content will remain in the gasoline.

Turning back to FIG. 1, the process for achieving sulfur specification for the gasoline stream where mercaptans are targeted for greatest removal is shown with thiophene polishing reactor 60 and mercaptan polishing reactor 80. Understanding that the sulfur content being delivered to the thiophene polishing reactor 60 is about 30-300 ppm, which is quite low but is still too high for meeting specification. Thiophene polishing reactor is operated to reduce the thiophenic component of sulfur content to a level that is below 10 ppm understanding that when discharged from the thiophenic polishing reactor 60, the total sulfur content is likely to still be above the 10-ppm specification. Sulfur in both thiophenic form and mercaptan form is converted in the thiophenic polishing reactor 60 with the hydrogen sulfide exiting with the light ends at top outlet 65. The gasoline stream is discharged from the thiophenic polishing reactor 60 at bottom outlet 69, heated to a higher temperature at heater 77 and fed to mercaptan polishing reactor 80.

Figure 2:
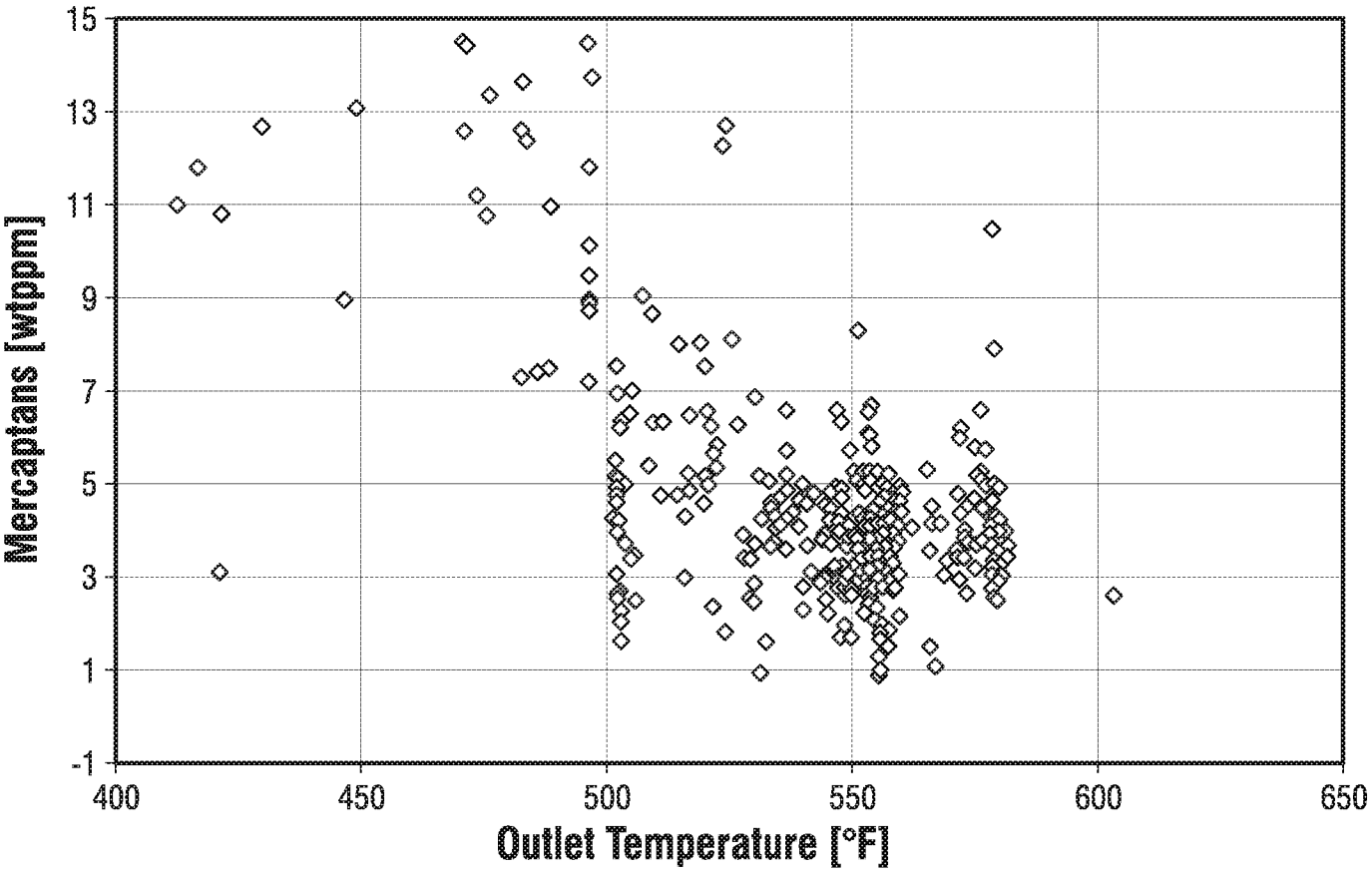
FIG. 2 is a chart showing mercaptan content relative to reactor outlet temperature where higher temperature is correlated to lower sulfur content in the resulting gasoline.

The gasoline stream is delivered into the mercaptan reactor 80 where the sulfur conversion is focused on the mercaptan compounds. The catalyst in catalyst bed 81 is a less chemically active hydrodesulfurization catalyst, but the temperature is notably higher, around 260 to 300° C. or about 500 to 570° F. where the temperature, in comparison, in the thiophenic polishing reactor 60 is about 250 to 260 or about 480 to 500° F. A such, mercaptan based sulfur content is driven down to about 3 ppm as seen in the chart shown in FIG. 2 where the higher temperature translates to lower mercaptan content. If the sulfur content provided by other species, specifically including thiophenic compounds is 7 or less, then the gasoline stream would be very close meeting a 10-ppm sulfur specification.

The invention may be accomplished by having two polishing reactors with piping and valves to direct partially desulfurized gasoline in to one polishing reactor, the other polishing reactor, the two in series with either physical reactor being upstream of the other. This affords considerable operational flexibility for the refinery in that when lower sulfur gasoline is produced by the hydrodesulfurizing reactors upstream of the polishing, only one polishing reactor would be in use to meet specification. During that operation, the polishing catalyst would age. Then that reactor may be operated to be second in the series of the two polishing reactors under higher temperature conditions to reduce mercaptans. And the catalyst may be deactivated or further deactivated using known catalyst poisons.

The desulfurized gasoline stream product is delivered at outlet 99 from separator 90 that separates off any remaining light ends Having 70 percent of the sulfur present in the gasoline being in the form of thiophenes, the aromatic content may preserve 1 to 2 octane numbers which translates into considerable value. If the octane rating of a volume of gasoline becomes too diminished, expensive octane enhancing materials must be added. On the other hand, excess octane number in the gasoline product makes that product itself an octane enhancing material for low octane gasoline feedstock. The value differences between octane excess materials and octane deficient materials can be quite substantial.

Catalysts for hydrodesulfurization are commonly based on molybdenum sulfide containing smaller amounts of cobalt or nickel and are formulated such that some catalysts have higher catalytic activity and others have lower activity. Understanding that the mercaptan polishing reactor must have a catalyst that is much less active for thiophenic conversion to finalize the sulfur polishing of the gasoline product and especially as compared to the catalyst selected for the thiophenic polishing reactor is an important distinction to operating the present invention. Using a deactivated catalyst of the same type as in the first reactor is one way of arranging the refinery in accordance with the present invention, however, a different catalyst such as nickel-alumina catalyst would like cause much more conversion of mercaptans and minimal conversion of thiophenes and higher-octane gasoline species. The two polishing reactors are not simply more of the same reaction but are targeted differently to get an octane advantage while meeting sulfur specification.

EXAMPLE

To provide an example of the invention, representative feed gasoline was provided through four arrangements. The first arrangement is a single polishing reactor with fresh catalyst. The second arrangement directs the product through two successive polishing reactors both with fresh catalyst in each. The third is where there are dual polishing reactors, but the second uses an aged or deactivated catalyst and the temperature is increased by 25° F. over the first reactor. The last is the same except that the temperature difference is 50° F. above the first reactor. The inputs, conditions and results are all shown in Table 1 below. The key point is that in the second to last arrangement, the octane loss was 0.57 RON and the last arrangement the RON lose is 0.48 while the other two arrangements included a greater octane loss. The lower octane loss is confirmed by the relative content of thiophenes to other sulfur molecular species in that conversion of thiophenes correlates to conversion of higher octane species in gasoline.

TABLE 1

| Parameter | Units | Single Reactor (Fresh) | Dual Reactors (Fresh→Fresh) | Dual Reactors (Fresh→Deactive) | Dual Reactors (Fresh→Deactive) |
|---|---|---|---|---|---|
| Inputs | | | | | |
| Feed Sulfur | ppm | 150 | 150 | 150 | 150 |
| Feed Thiophenes | ppm | 100 | 100 | 100 | 100 |
| Feed Mercaptans | ppm | 50 | 50 | 50 | 50 |
| dT between beds | ° F. | 0 | 0 | 25 | 50 |

TABLE 1-continued

| Parameter | Units | Single Reactor (Fresh) | Dual Reactors (Fresh→Fresh) | Dual Reactors (Fresh→Deactive) | Dual Reactors (Fresh→Deactive) |
|---|---|---|---|---|---|
| Reaction I Relative Activity | % | 100% | 100% | 100% | 100% |
| Reaction II Relative Activity | % | 0% | 100% | 0% | 0% |
| Outputs | | | | | |
| Octane Loss (average) | RON | 0.70 | 0.96 | 0.57 | 0.48 |
| Product Sulfur (average) | ppm | 10 | 10 | 10 | 10 |
| Product Thiophenes (average) | ppm | 0.4 | 0.1 | 1.6 | 2.9 |
| Product Mercaptans (average) | ppm | 9.7 | 9.9 | 8.5 | 7.1 |

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A system for desulfurizing a gasoline stream to or below a target sulfur content specification for finished gasoline that also minimizes concurrent octane loss, wherein the system comprises:

a first hydrodesulfurizing reactor with a hydrogen feed and hydrodesulfurizing catalyst at catalytic conditions to convert hydrogen and sulfur compounds to hydrocarbons and hydrogen sulfide to create a first pass sulfur converted gasoline stream;

a separator for separating hydrogen sulfide from the first pass sulfur converted gasoline stream to create a first pass desulfurized gasoline stream;

one or more additional hydrodesulfurizing reactors each having a hydrogen feed and hydrodesulfurizing catalyst at catalytic conditions to convert hydrogen and sulfur compounds to hydrocarbons and hydrogen sulfide to create a follow-up pass sulfur converted gasoline stream;

a separator for separating hydrogen sulfide from the follow-up pass sulfur converted gasoline stream to create a follow-up pass desulfurized gasoline stream;

a thiophenic polishing reactor with a hydrodesulfurizing catalyst where the catalyst is selected to have a first polishing catalytic activity to convert thiophenes and mercaptans to hydrogen sulfide and hydrocarbons and where the sulfur content in the thiophenes is thereby reduced to a level below the target specification for finished gasoline, but where the total sulfur content is still above the target specification for finished gasoline creating a sulfur converted semi-polished gasoline stream;

a separator for separating hydrogen sulfide from the sulfur converted semi-polished gasoline stream to create a degassed semi-polished gasoline stream;

a heater for heating the degassed semi-polished gasoline stream to a higher temperature;

a mercaptan polishing reactor having a hydrodesulfurizing catalyst where the catalyst is selected to have a second polishing catalytic activity but where the second polishing catalytic activity is selected to be less active for thiophene conversion such that within the mercaptan polishing reactor the mercaptans are converted to hydrogen sulfide and hydrocarbons where the sulfur content in the mercaptans becomes less than the sulfur content in the thiophenes and wherein the total sulfur content of the gasoline is reduced to a level equal to or below the target specification for finished gasoline to create a sulfur converted fully polished gasoline stream;

a separator for separating hydrogen sulfide from the sulfur converted fully polished gasoline stream to create a degassed fully polished gasoline stream.

2. The system according to claim 1 wherein the separator for separating the hydrogen sulfide from the first pass sulfur converted gasoline stream is within the first hydrodesulfurizing reactor.

3. The system according to claim 1 wherein the separator for separating the hydrogen sulfide from the follow-up pass sulfur converted gasoline stream is within the one or more additional hydrodesulfurizing reactors.

4. The system according to claim 1 wherein the separator for separating the hydrogen sulfide from the sulfur converted semi-polished gasoline stream is within the thiophenic polishing reactor.

5. The system according to claim 1 wherein the separator for separating the hydrogen sulfide from the sulfur converted fully-polished gasoline stream is within the mercaptan polishing reactor.

6. The system according to claim 1 wherein system is free of any hydrogen feed arrangement in to the mercaptan reactor.

7. The system according to claim 1 wherein system includes piping and valves to alter the flow of the follow-up pass desulfurized gasoline stream such that the follow-up pass desulfurized gasoline stream may pass first to the mercaptan polishing reactor and second to the thiophenic polishing reactor so that deactivated catalyst in the thiophenic polishing reactor may be used to reduce mercaptan content of the stream.

* * * * *